US008424548B2

(12) United States Patent
Willey

(10) Patent No.: US 8,424,548 B2
(45) Date of Patent: Apr. 23, 2013

(54) ELECTRICAL SHOCK DEFENSIVE WALKING CANE

(76) Inventor: Glenn M. Willey, Northridge, CA (US)

( * ) Notice: Subject to any disclaimer, the term of this patent is extended or adjusted under 35 U.S.C. 154(b) by 324 days.

(21) Appl. No.: 12/818,902

(22) Filed: Jun. 18, 2010

(65) Prior Publication Data

US 2010/0319740 A1 Dec. 23, 2010

Related U.S. Application Data

(60) Provisional application No. 61/269,053, filed on Jun. 19, 2009.

(51) Int. Cl.
*A45B 3/00* (2006.01)
*A45B 3/04* (2006.01)

(52) U.S. Cl.
USPC ..... 135/66; 135/70; 135/75; 135/77; 362/102; 361/232; 463/47.3

(58) Field of Classification Search ..... 135/65–66, 135/70, 72, 77–81, 911, 75; 463/47.3–47.7; 362/102, 109, 232; 361/232–233, 235; 231/3, 231/7

See application file for complete search history.

(56) References Cited

U.S. PATENT DOCUMENTS

| | | | | | |
|---|---|---|---|---|---|
| 2,176,994 | A | * | 10/1939 | Hansen et al. | 231/7 |
| 2,733,003 | A | * | 1/1956 | Abildgaard et al. | 231/7 |
| 3,362,711 | A | * | 1/1968 | Larsen et al. | 463/47.3 |
| 3,885,733 | A | * | 5/1975 | Klebold et al. | 231/7 |
| 4,093,969 | A | * | 6/1978 | Maynor, Jr. | 361/232 |
| 4,483,562 | A | * | 11/1984 | Schoolman | 294/104 |
| 4,977,914 | A | * | 12/1990 | Smerker | 135/81 |
| 5,986,872 | A | * | 11/1999 | Chaput | 361/232 |
| 6,791,816 | B2 | * | 9/2004 | Stethem | 361/232 |
| 7,243,668 | B1 | * | 7/2007 | Kroeze | 135/77 |
| 7,421,933 | B1 | | 9/2008 | Pearson | |
| D611,114 | S | | 3/2010 | Pennington | |
| 2006/0266397 | A1 | * | 11/2006 | Berl | 135/70 |
| 2009/0199884 | A1 | | 8/2009 | Lessing | |

* cited by examiner

*Primary Examiner* — Winnie Yip
(74) *Attorney, Agent, or Firm* — Robert M. Sperry

(57) ABSTRACT

A combination ambulatory assistance and electrical shock defensive device includes an elongated body of adjustable length and having a hand grip at one end thereof and a foot pad at a generally opposite end thereof. A high-voltage power unit is associated with the body and actuated by a trigger mechanism. Conductive contacts extend through the foot pad and are conductively coupled to the high-voltage power unit.

19 Claims, 4 Drawing Sheets

ELECTRICAL SHOCK DEFENSIVE WALKING CANE

BACKGROUND OF THE INVENTION

The present invention generally relates to electrical shock defensive devices, such as stun guns and the like. More particularly, the present invention is directed to an electrical shock or stun staff, walking stick, or cane which can be used for defensive purposes for protecting a user thereof.

Personal safety is becoming an increasing problem with high crime rates and many streets unsafe. With the elderly, the problem is even more severe since they are viewed as easy prey to criminals because of their lack of dexterity and strength. There is also a concern with both the elderly and non-elderly when walking the streets, neighborhoods, etc. when stray dogs approach the individual. Such dogs can be menacing, and in some cases even bite and attack the individual. There is also a concern when hiking in the wilderness of being attacked by wildlife.

There are many concerns associated with carrying a lethal firearm, such as a gun or the like. Many states have strict laws concerning carrying and using such firearms. Moreover, the individual does not necessarily want to inflict a lethal blow to the attacking person or animal, but rather subdue or avert the attacker.

Over the years, a number of hand-held electrical shocking devices, sometimes referred to as stun guns, have been developed with varying degrees of success. For example, projectile-type stunning devices, such as the TASER™ device, project conductive barbs attached to a length of conductive wire for stunning and subduing the attacker. Such TASER stun guns are oftentimes used by law enforcement. However, these are limited due to a number of practical considerations, not the least of which is their "one shot" or "shallow magazine" nature which precludes their being used against multiple subjects. Moreover, since such stun guns fire a projectile, they may be classified as a firearm and their use restricted in many states.

U.S. Pat. No. 7,421,933 B1 to Pearson discloses a telescoping stun gun, which is similar in nature to an expandable baton used by law enforcement officials and the like. The individual holds the baton-like device and flicks his or her wrist to fully extend the device in order to inflict a defensive electrical shock to the would-be attacker. However, such a device has a very limited use and is not particularly well-suited for the elderly or the like. Nor does it act as an ambulatory assistance device, in the form of a staff or cane, whatsoever.

U.S. Publication No. 2009/0199884 A1 to Lessing discloses an electrical shock defensive walking stick or cane. However, this walking stick is quite complicated in that it has electrical stingers which are extended by a mechanism out of the end of the cane or walking stick when in use. Aside from increasing the complexity and cost of the device, there arises the distinct possibility that such electrical prongs could be damaged when in use.

Neither of the devices listed above provide any means for becoming disabled when taken from the owner, so as not to be used against the owner of the device. Nor do the devices described above provide adjustability and use as a walking stick or cane by individuals of different sizes. Accordingly, there is a continuing need for a device which serves as both an ambulatory assistance device in the form of a walking stick, cane or the like, as well as an electrical shock defensive device. There is also a continuing need for such a device which will become automatically disabled when taken away by force from the user. There is also a continuing need for such a device which is capable of being used for both purposes, and adjustable to meet the needs of different sized users. The present invention fulfills these needs and provides other related advantages.

SUMMARY OF THE INVENTION

The present invention resides in a combination ambulatory assistance and electrical shock device. The device generally comprises an elongated, rigid ambulatory assist body having a hollow interior space along at least a portion of a length thereof. In a particularly preferred embodiment, the body is selectively expandable and retractable in length. The body may be comprised of a first tubular member and a second tubular member which is at least partially disposable within the first tubular member. A locking mechanism selectively locks the second tubular member in relation to the first tubular member, to enable expansion and retraction of the length of the body. The locking mechanism typically comprises a series of aligned apertures formed in the first tubular member, and a spring biased pin coupled to the second tubular member and selectively insertable into one of the apertures of the first tubular member.

A high-voltage power unit is operably associated with the body. The power unit comprises a battery and a voltage amplifying circuit. A trigger mechanism selectively actuates the high-voltage power unit. The trigger mechanism, in one embodiment, comprises a powering switch and a high-voltage discharge switch.

A hand grip is connected to a top end of the body. A foot pad is connected to a generally opposite bottom end of the body. Conductive contacts extend through the foot pad and are conductively coupled to the high-voltage power unit. Typically, an electrical cord extends between the power unit and the conductive contacts. At least a portion of the electrical cord is coiled so as to be able to extend between the power unit and the conductive contacts when the body length is fully extended. The foot pad includes a rim and a bottom wall which cooperatively define a recessed cavity. The conductive contacts partially extend into the recessed cavity.

Preferably, a safety key is manually removably coupled to the high-voltage power unit. The safety key may be attached to a wrist strap. High voltage may be supplied to the conductive contacts when the safety key is coupled to the power unit and the trigger mechanism is actuated. However, supply of high voltage to the conductive contacts is prevented when the safety key is removed from the power unit.

An illumination device may be coupled to the body for illuminating an area adjacent to, or generally aligned with, the foot pad.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

As shown in the accompanying drawings, for purposes of illustration, the present invention resides in a device which both assists in ambulatory movement, such as being in the form of a cane, walking stick, staff or the like, and which also serves as an electrical shock defensive device, also known as a stun gun.

Figure 1:
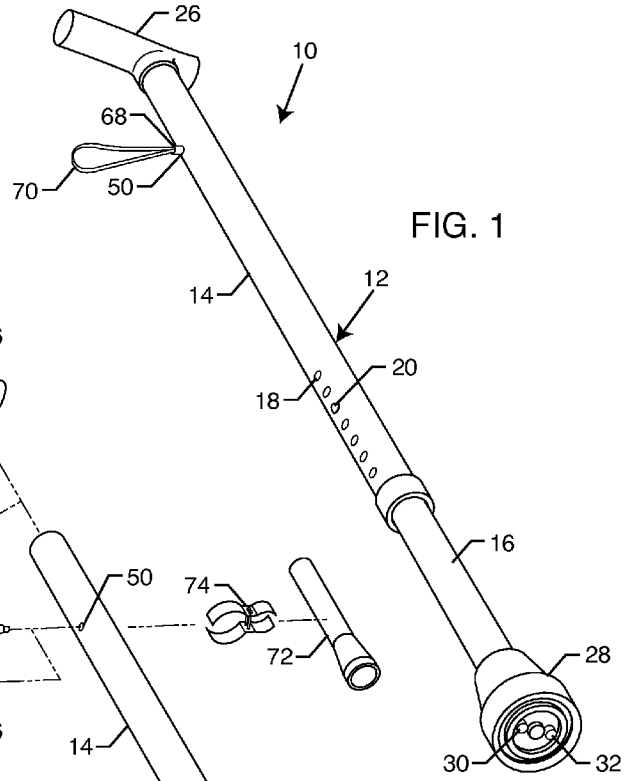
FIG. 1 is a perspective view of an electrical shock defensive device embodying the present invention.
Figure 2:
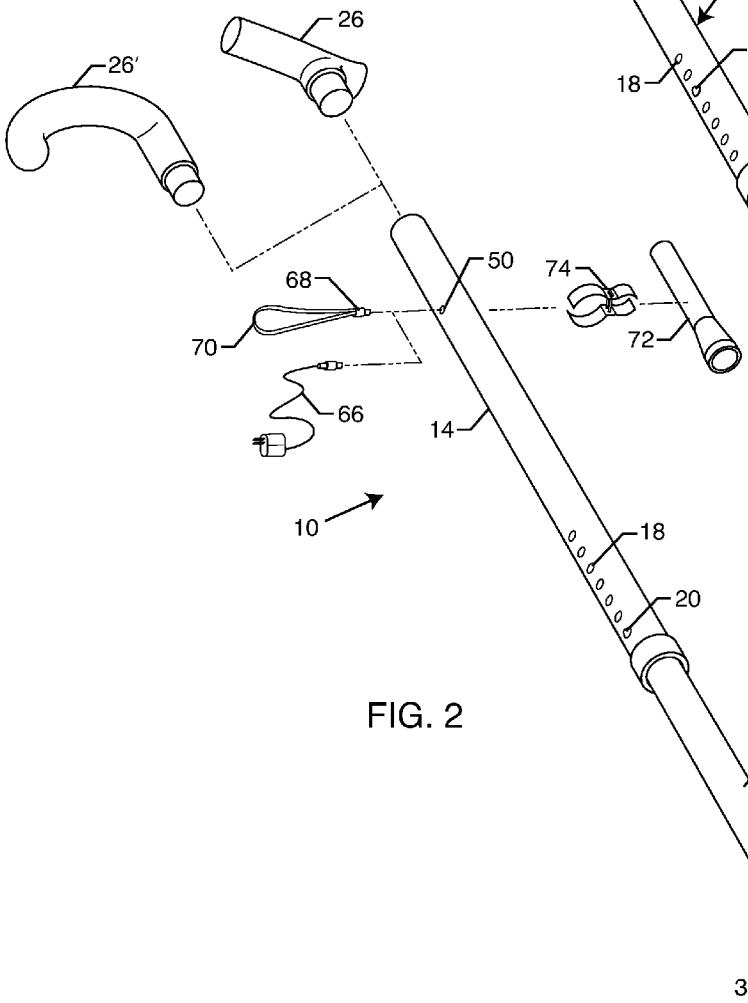
FIG. 2 is a partially exploded perspective view of an electrical shock defensive device embodying the present invention, and illustrating a body thereof in an extended position, and various attachments.
Figures 3, 4:
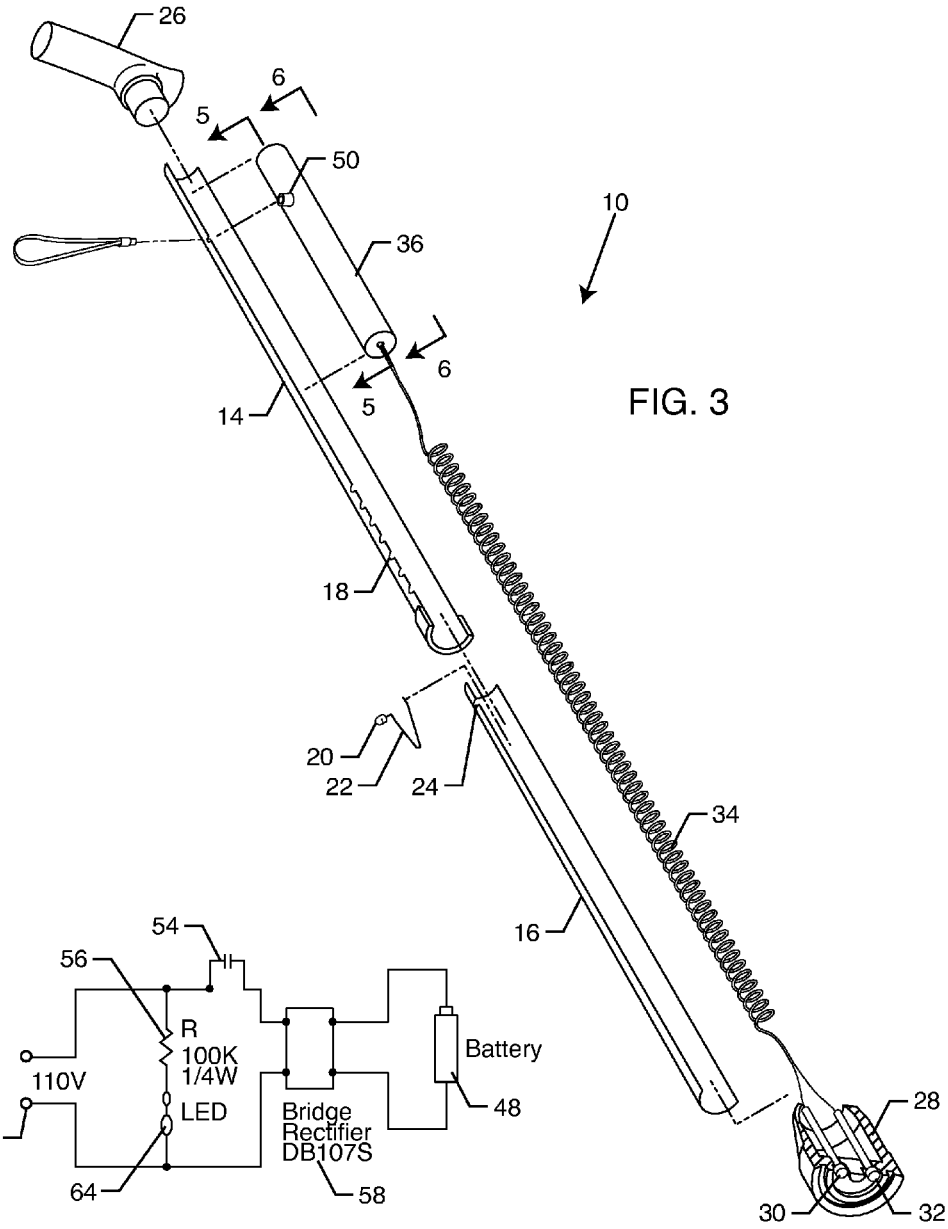
FIG. 3 is a partially exploded perspective and section view, illustrating the various component parts of the device of the present invention.
FIG. 4 is an electrical schematic of a power unit of the device.

With reference to FIG. 1, the device 10 is generally comprised of an elongated and rigid ambulatory assist body 12. As illustrated in FIGS. 1-3, in one embodiment, the body 12 comprises a first tubular member 14 and a second tubular member 16. The second tubular member 16 is at least partially disposable within the first tubular member 14. For example, the second tubular member 16 may have an outer diameter which is slightly less than the inner diameter of the first tubular member 14, so as to be slidably moved and repositioned with respect thereto. As will be explained more fully herein, the body 12 has a hollow interior space along at least a portion of a length thereof. The use of two nesting tubes 14 and 16 accomplishes this purpose and enables the necessary electronic components and the like to be conveniently disposed therein.

With continuing reference to FIGS. 1-3, in a particularly preferred embodiment, in order to accommodate users of different heights, the body 12 is adjustable in length. That is, there is a locking mechanism associated with the nesting tubes 14 and 16. One such locking mechanism comprises a series of aligned apertures 18 formed in one of the tubular members, illustrated as being formed in the first tubular member 14, and a spring-biased pin 20 which is selectively insertable into one of the apertures 18. With reference to FIG. 3, a spring 22 is shown attached to the pin 20, and coupled to the second tubular member 16. An aperture 24 is formed in the tubular member 16 such that the pin 20 can be pushed and recessed downwardly, and the tubular members 14 and 16 positioned with respect to one another by expanding or retracting the length of the body 12, and the pin 20 allowed to re-insert itself into one of the aligned apertures 18 to lock the tubular body members 14 and 16 in place with respect to one another. It will be appreciated that other locking mechanisms could be employed to lock the body members 14 and 16 with respect to one another so as to selectively adjust the length of the body 12.

A hand grip 26 is attached to a top end of the body 12. FIG. 2 illustrates the replacement of the hand grip 26 with another type of hand grip 26'. It will be appreciated by those skilled in the art that the hand grip 26 can take on a variety of shapes and configurations. The important aspect is that the device 10 be capable of being held conveniently by the user. In a particularly preferred embodiment of the invention, the device 10 is in the form of a walking cane, as illustrated. Thus, the hand grip 26 will be in the form of a cane walking grip. However, if the device 10 were in the form of a staff, walking stick or the like, the hand grip 26 could take on a different configuration to suit that particular need.

At a generally opposite, and typically bottom, end of the body 12 is connected a foot pad 28. Conductive contacts 30 and 32 extend through the foot pad 28, which is typically comprised of an elastomeric material or the like. As illustrated in FIG. 3, an electrical wire 34 interconnects the conductive contacts 30 and 32 with a power unit 36 of the device. At least a portion of the length of the wire 34 is coiled or spiral in nature, so as to expand and retract as the body 12 is expanded and retracted in length.

Figure 7:
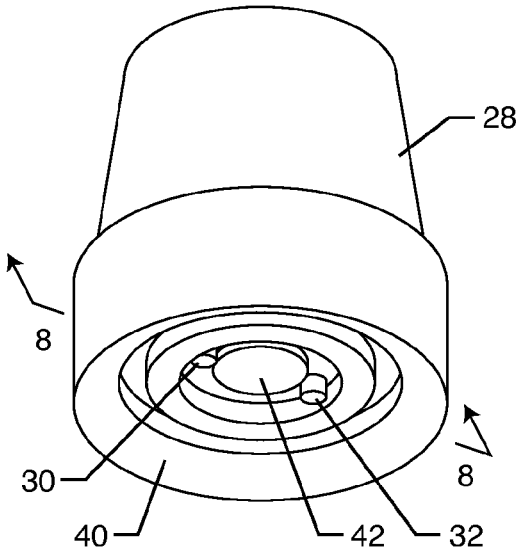
FIG. 7 is a perspective view of a foot pad used in accordance with the present invention.
Figure 8:
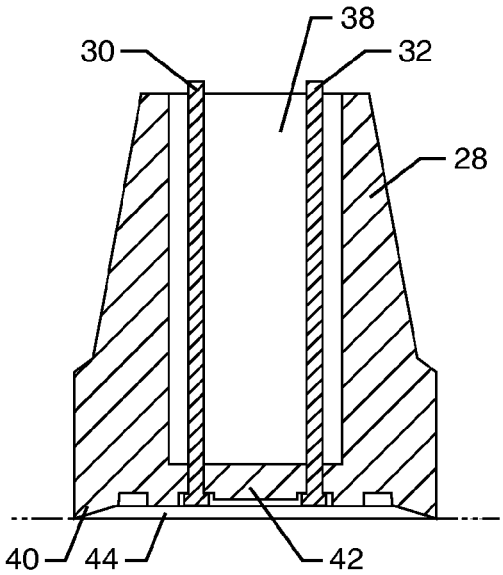
FIG. 8 is a cross-sectional view taken generally along line 8-8 of FIG. 7, illustrating conductive contacts extending through the foot pad.
Figure 9:
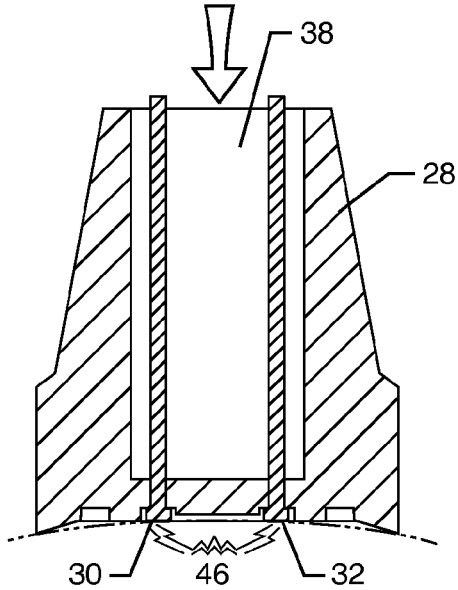
FIG. 9 is a cross-sectional view similar to FIG. 8, illustrating activation of the device with the foot pad engaged with a surface in accordance with the present invention.

With reference now to FIGS. 7-9, it will be seen that the foot pad 28 is at least partially hollow so as to provide at least one passageway 38 for the conductive contacts 30 and 32 to extend therethrough. The foot pad 28, in a particularly preferred embodiment, includes a rim 40 and a bottom exterior wall 42 which cooperatively define a recessed cavity. The conductive contacts 30 and 32 extend only partially into the recessed cavity, as illustrated in FIGS. 7 and 8. As can be seen in FIG. 7, the foot pad 28 may in fact include more than an outer peripheral rim 40, but in addition other concentric rims or rings as well. The important aspect of this configuration is that the one or more rims or projections 40 of the foot pad 28 extend a distance beyond the conductive contacts 30 and 32. The conductive contacts 30 and 32 are typically comprised of a conductive material, such as a metal. The foot pad 28 is typically comprised of an elastomeric material or shock absorbing material or the like so as to make contact with the ground surface, similar to conventional canes and walking sticks. In order to protect the conductive contacts 30 and 32 from excessive wear due to repeated contact with the ground, the rim(s) 40 contacts the ground surface. However, when the device 10 is actuated and used in defense of the owner, such as when applying electro shock to an attacker, the soft, fleshy portion of the attacker is pushed into the recessed cavity 44 area, as illustrated in FIG. 9, and the high-voltage arc extends between the conductive contacts 30 and 32, delivering an electrical shock to the attacker.

As described above, the attacker may be a person, a wild animal, a dog, etc. It will be understood that the arc of electricity 46 between the conductive contacts 30 and 32 will provide electrical shock to the attacker or surface even if the surface does not come into full contact with the conductive contacts 30 and 32.

Figure 5:
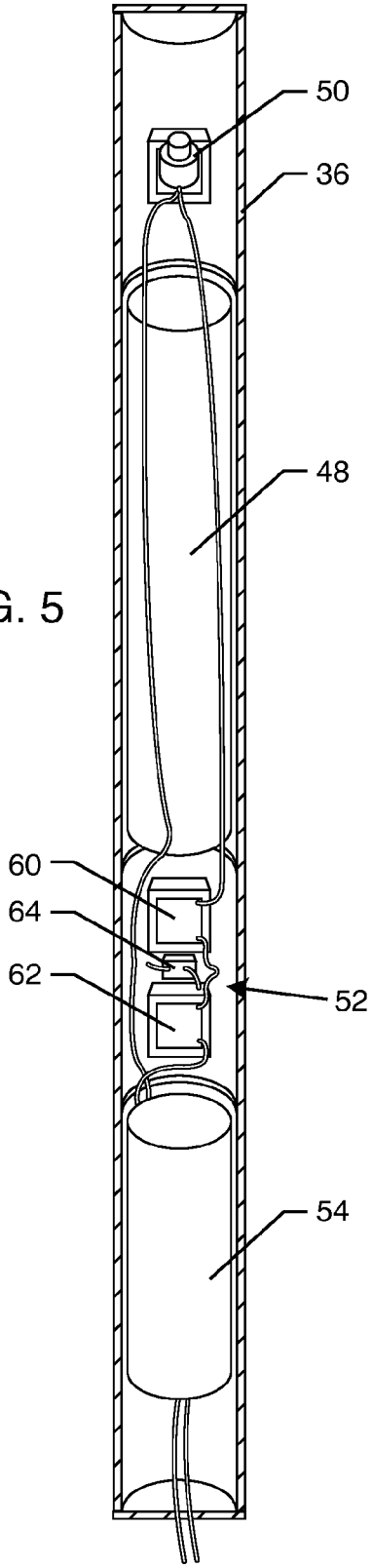
FIG. 5 is a partially sectioned and elevational view illustrating a power unit and trigger mechanism of the device.
Figure 6:
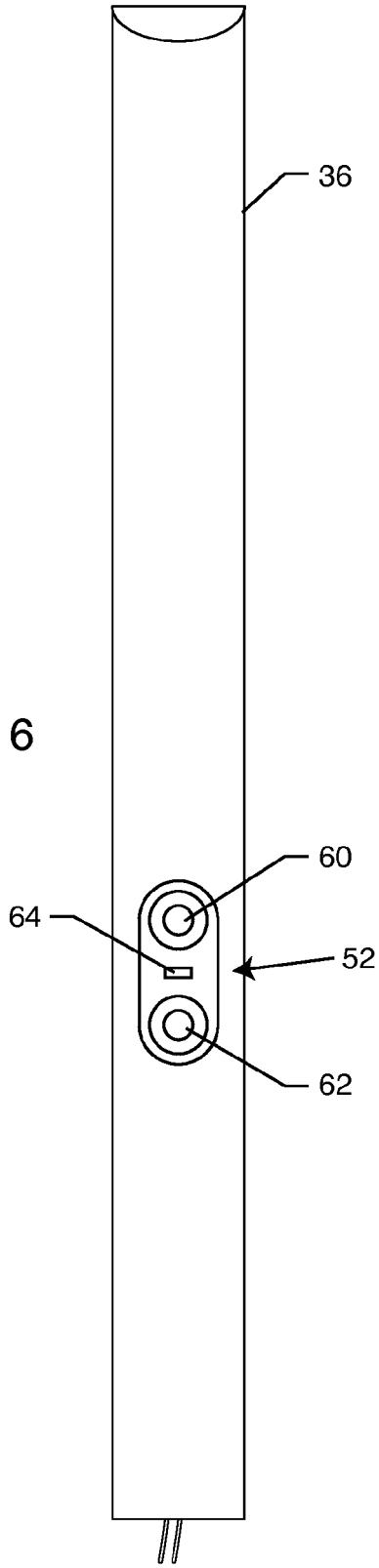
FIG. 6 is a front elevational view illustrating the power unit and the trigger mechanism of the device.

With reference now to FIGS. 4-6, the power unit 36 is generally comprised of a battery and a voltage amplifying circuit. FIGS. 4 and 5 illustrate the typical electrical components of the power unit 36. In a preferred embodiment, a rechargeable battery 48, such as a lithium or nickel metal hydride battery 48 is operably connected between a power input socket 50 and a trigger mechanism 52. The battery 48 powers a capacitor 54, as is well known in stun gun technology. As illustrated in FIG. 4, the power unit 36 includes the power inlet socket 50, a resistor 56, the capacitor 54, a bridge rectifier 58, and the battery 48. Preferably, the circuitry also includes a light-emitting diode (LED) 64 for informing the user that the trigger mechanism 52 has been actuated. The circuit illustrated in FIG. 4 enables the recharging of the battery 48 from an alternating current source, which is changed to a direct current to recharge battery 48. The circuit illustrated in FIG. 4 also powers the capacitor 54 so as to supply a high-voltage source of electricity to the conductive contacts 30 and 32 when desired.

With reference now to FIG. 6, the trigger mechanism 52 includes a powering or arming switch 60 as well as a discharging switch 62. By depressing or actuating the arming or power switch 60, power is supplied to the capacitor 54. LED 64 will illuminate to indicate that the capacitor 54 has been powered. Thereafter, the user depresses high-voltage discharge switch 62, which supplies a high voltage from the capacitor 54 to the conductive contacts 30 and 32. The discharge switch 62 can be depressed repeatedly after power is provided to the capacitor 54. However, instead of depressing the discharge switch 62, the user may depress the power switch 60 again, cutting off the source of electricity from the battery 48 to the capacitor 54.

With reference now to FIGS. 1-3, as previously described, there is an electrical socket or input port 50 which can receive a recharging device 66, such as having an AC wall socket and plug insertable into the socket 50. This is used to recharge the battery 48 periodically.

The present invention also incorporates the use of a safety key 68, typically attached to a wrist strap 70. When the safety key 68 is inserted, such as in power socket 50, a complete electrical circuit is formed between the battery 48 and capacitor 54 and other electrical components of the power unit. This closed circuit enables the trigger mechanism 52 to be actuated and deliver a high-voltage discharge to the conductive contacts 30 and 32. However, when the safety key 68 is manually removed, such as removing the safety key 68 from the socket 50, as illustrated in FIG. 2, an open circuit is created and the high-voltage discharge cannot be relayed from the power unit to the conductive contacts 30 and 32. This serves several purposes. For example, a grandparent may have concern that grandchildren would find the device 10 of the present invention and inflict injury upon another. Removal and separate storage of the safety key 68 apart from the device 10 renders the electrical shock aspect of the device 10 inert and unusable. As mentioned above, the safety key 68 is preferably attached to an end of a wrist strap 70. This wrist strap 70 would be attached to the user's wrist while walking with the device 10. In the event an attacker is able to wrestle away the device 10 from the user or owner, the wrist strap 70, which would be attached to the user's wrist, would automatically pull out the safety key 68 from the device, rendering the electrical shock component of the device 10 inoperable by the would-be attacker.

With reference again to FIG. 2, in one embodiment, an illumination device 72, such as a flashlight or the like, is coupled to the body 12. This may be done, for example, by utilizing a clamp 74, which clamps to both the body 12 as well as the flashlight 72. The illumination device illuminates an area adjacent to, or generally aligned with, the foot pad 28. This can be used to assist the user in viewing the walking area immediately in front of the user, as well as illuminating a would-be attacker. Not only does such illumination assist the user in correctly aiming and stabbing towards the attacker, but could potentially also deter any such attack.

Actuation of the device, even in the air without touching a surface, creates an electrical arc between the contacts 30 and 32 which makes a harsh crackling sound and displays a bright electrical arc, which may also deter the would-be attacker. In the event that the attacker persists, the user can apply electrical shock to the attacker by pushing the foot pad 28 against the attacker and discharging a high voltage between the conductive contacts 30 and 32. Such high voltage would apply a non-lethal, but effective discharge to the attacker. The rigid body 12, aside from supporting the weight of the individual as the individual walks, can also be used as a striking baton against the attacker as well.

Although several embodiments have been described in detail for purposes of illustration, various modifications may be made without departing from the scope and spirit of the invention. Accordingly, the invention is not to be limited, except as by the appended claims.

What is claimed is:

1. A combination ambulatory assistance and electrical shock defensive device for assisting a person to walk, comprising:

an elongated, rigid ambulatory assist body having a hollow interior space along at least a portion of a length thereof;

a hand grip connected to a top end of the body;

a foot pad connected to a generally opposite bottom end of the body, said foot pad including a rim and a bottom wall, said bottom wall having a recessed cavity; a high voltage power unit, comprising a battery and a voltage amplifying circuit, operably associated with the body;

conductive contacts immovably mounted flush with the foot pad and conductively coupled to the high voltage power unit, wherein said conductive contacts partially extending into the recessed cavity and flushed with the bottom wall of the foot pad;

a trigger mechanism which selectively actuates the high voltage power unit; and a safety key manually removably coupled to the high voltage power unit, wherein high voltage may be supplied to the conductive contacts when the safety key is coupled to the power unit and the trigger mechanism actuated, and wherein supply of high voltage to the conductive contacts is prevented when the safety key is removed from the power unit.

2. The device of claim 1, wherein the safety key is attached to a wrist strap.

3. The device of claim 1, wherein the body is selectively expandable and retractable in length.

4. The device of claim 3, wherein the body is comprised of a first tubular member and a second tubular member at least partially disposable within the first tubular member and a locking mechanism for selectively locking the second tubular member in relation to the first tubular member.

5. The device of claim 4, wherein the locking mechanism comprises a series of aligned apertures formed in the first tubular member and a spring biased pin coupled to the second tubular member and selectively inerrable into one of the apertures of the first tubular member.

6. The device of claim 3, including an electrical cord extending between the power unit and the conductive contacts, at least a portion of the electrical cord being coiled so as to extend between the power unit and the conductive contacts when the body length is fully extended.

7. The device of claim 1, wherein the trigger mechanism comprises a powering switch and a high voltage discharge switch.

8. The device of claim 1, including an illumination device coupled to the body for illuminating an area adjacent to, or generally aligned with, the foot pad.

9. A combination ambulatory assistance and electrical shock defensive device for assisting a person to walk, comprising:

an elongated, rigid ambulatory assist body having a hollow interior space along at least a portion of a length thereof, wherein the body is comprised of a first tubular member and a second tubular member at least partially disposable within the first tubular member and a locking mechanism for selectively locking the second tubular member in relation to the first tubular member so as to selectively extend and retract the length of the body;

a hand grip connected to a top end of the body;

a foot pad connected to a generally opposite bottom end of the body, said foot pad including a rim and a bottom wall, said bottom wall having a recessed cavity;

a high voltage power unit, comprising a battery and a voltage amplifying circuit, operably associated with the body;

conductive contacts immovably mounted flush with the foot pad and conductively coupled to the high voltage power unit, the conductive contacts partially extending into the recessed cavity and flushed with the bottom wall of the foot pad;

an electrical cord extending between the power unit and the conductive contacts, at least a portion of the electrical cord being coiled so as to extend between the power unit and the conductive contacts when the body length is fully extended; and a trigger mechanism which selectively actuates the high voltage power unit.

10. The device of claim 9, wherein the locking mechanism comprises a series of aligned apertures formed in the first tubular member and a spring biased pin coupled to the second tubular member and selectively inerrable into one of the apertures of the first tubular member.

11. The device of claim 9, including a safety key manually removably coupled to the high voltage power unit, wherein high voltage may be supplied to the conductive contacts when the safety key is coupled to the power unit and the trigger mechanism actuated, and wherein supply of high voltage to the conductive contacts is prevented when the safety key is removed from the power unit.

12. The device of claim 11, wherein the safety key is attached to a wrist strap.

13. The device of claim 9, wherein the high voltage power unit comprises a battery and a voltage amplifying circuit.

14. The device of claim 9, wherein the trigger mechanism comprises a powering switch and a high voltage discharge switch.

15. The device of claim 9, including an illumination device coupled to the body for illuminating an area adjacent to, or generally aligned with, the foot pad.

16. A combination ambulatory assistance and electrical shock defensive device for assisting a person to walk, comprising:

an elongated, rigid ambulatory assist body having a hollow interior space along at least a portion of a length thereof;

a hand grip connected to a top end of the body;

a foot pad connected to a generally opposite bottom end of the body;

a high voltage power unit, comprising a battery and a voltage amplifying circuit, operably associated with the body having conductive electrodes immovably mounted flush with said foot pad; and a trigger mechanism which selectively actuates the high voltage power unit; wherein the food pad includes a rim and a bottom wall, said bottom wall having a recessed cavity, the conductive contacts partially extending into the recessed cavity and flushed with the bottom wall.

17. The device of claim 16, including a safety key attached to a wrist strap and manually removably coupled to the high voltage power unit, wherein high voltage may be supplied to the conductive contacts when the safety key is coupled to the power unit and the trigger mechanism actuated, and wherein supply of high voltage to the conductive contacts is prevented when the safety key is removed from the power unit.

18. The device of claim 16, wherein the body is comprised of a first tubular member and a second tubular member at least partially disposable within the first tubular member and a locking mechanism for selectively locking the second tubular member in relation to the first tubular member for selectively extending and retracting the length of the body, and including an electrical cord extending between the power unit and the conductive contacts, at least a portion of the electrical cord being coiled so as to extend between the power unit and the conductive contacts when the body length is fully extended.

19. The device of claim 16, including an illumination device coupled to the body for illuminating an area adjacent to, or generally aligned with, the foot pad.

* * * * *